US008193887B2

(12) United States Patent
Sohn

(10) Patent No.: US 8,193,887 B2
(45) Date of Patent: Jun. 5, 2012

(54) MONOSTABLE PERMANENT MAGNETIC ACTUATOR USING LAMINATED STEEL CORE

(75) Inventor: Jong-Mahn Sohn, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 243 days.

(21) Appl. No.: 12/654,125

(22) Filed: Dec. 11, 2009

(65) Prior Publication Data

US 2010/0164662 A1 Jul. 1, 2010

(30) Foreign Application Priority Data

Dec. 31, 2008 (KR) ..... 20-2008-0017509 U

(51) Int. Cl.
*H01F 5/00* (2006.01)
*H01F 3/00* (2006.01)

(52) U.S. Cl. ..... 335/299; 335/220; 335/297

(58) Field of Classification Search ..... 335/172, 335/177–182, 220–228, 229–237, 297, 299
See application file for complete search history.

(56) References Cited

U.S. PATENT DOCUMENTS 4,577,174 A * 3/1986 Lemmer ..... 335/261
4,829,947 A * 5/1989 Lequesne ..... 123/90.11
4,845,451 A * 7/1989 Uetsuhara et al. ..... 335/257
6,906,605 B2 * 6/2005 Lang ..... 335/179
7,236,071 B2 * 6/2007 Prestini et al. ..... 335/177
7,518,269 B2 4/2009 Lee
2004/0093718 A1 * 5/2004 Takeuchi et al. ..... 29/602.1
2005/0088265 A1 * 4/2005 Nakagawa et al. ..... 335/220

FOREIGN PATENT DOCUMENTS

CN 1836160 9/2006
JP 8-322225 12/1996

OTHER PUBLICATIONS

U.S. Appl. No. 12/636,159 to Sohn et al., filed Dec. 11, 2009.
China Office action, dated Jun. 9, 2011 along with an english translation thereof.

* cited by examiner

*Primary Examiner* — Bernard Rojas
(74) *Attorney, Agent, or Firm* — Greenblum & Bernstein P.L.C.

(57) ABSTRACT

A monostable permanent magnetic actuator using a laminated steel core, comprises: lamination cores formed as a plurality of metallic thin plates are laminated to each other; a coil disposed to be adjacent to the lamination cores, and configured to apply a magnetic force to the lamination cores by an external power; a mover mounted in the lamination cores so as to be movable in upper and lower directions; permanent magnets installed at the lamination cores, and configured to apply an upward and downward magnetic force to the mover; and an elastic means configured to apply an elastic force to the mover in an opposite direction to the permanent magnets.

6 Claims, 5 Drawing Sheets

Prior Art

MONOSTABLE PERMANENT MAGNETIC ACTUATOR USING LAMINATED STEEL CORE

RELATED APPLICATION

The present disclosure relates to subject matter contained in priority Korean utility model Application No. 20-2008-0017509, filed on Dec. 31, 2009, which is herein expressly incorporated by reference in its entirety.

BACKGROUND OF THE INVENTION

1. Field of the Invention

The present invention relates to a monostable permanent magnetic actuator using a laminated steel core, and particularly, to an actuator to operate a circuit breaker, a switch, etc. of power equipment.

2. Background of the Invention

As an actuator for power equipment, a spring mechanism, and a hydraulic or pneumatic actuator are generally used. However, the actuator has a large number of components, and has to control mechanical energy so as to obtain an adjustment force. Accordingly, the actuator has a complicated structure, and requires to be repaired.

In order to solve these problems, the conventional mechanism has been replaced by an actuator using permanent magnets and electric energy in the power equipment. The permanent magnetic actuator is configured such that a mover thereof is held at a stroke using magnetic energy of the permanent magnets, and electric energy is applied to a coil to move the mover to a stroke.

The permanent magnetic actuator may be categorized into a bistable type and a monostable type depending on a mechanism that the mover is held at a preset position. The bistable type permanent magnetic actuator is configured such that a mover can be held at both ends of a stroke due to permanent magnets, whereas the monostable type permanent magnetic actuator is configured such that a mover is held at only one of both ends of a stroke. The mover of the bistable type permanent magnetic actuator is held at a preset position by magnetic energy of permanent magnets upon opening or closing power equipment. Accordingly, the bistable type permanent magnetic actuator is more advantageous than the monostable type requiring for a separate maintenance mechanism, in that it can perform the closing/opening operation without a mechanical component such as a spring.

On the contrary, the monostable type actuator has the following advantages. Firstly, power equipment can be closed or opened by using one coil.

Secondly, the monostable type actuator is mounted with an open spring, thereby opening power equipment without an additional energy storage device (e.g. spring) in an opening device for an emergent case.

Thirdly, differently from the bistable type actuator, a closing or opening operation is implemented by one coil. This may allow a driving coil to have a large number of windings thereon. Since driving energy is proportional to a stroke, the mover of the monostable permanent magnetic actuator can be fabricated so as to have a long stroke.

FIGS. 1 and 2 are sectional views of an actuator in accordance with the conventional art. The actuator 10 of FIG. 1 comprises a middle cylinder 12 having a cavity, and a lower cylinder 14 coupled to a lower side of the middle cylinder 12. A close coil 18 for applying a downward magnetic force to the mover 16 by receiving external power is installed below the middle cylinder 12. An upper cylinder 20 is coupled to an upper side of the middle cylinder 12. And, permanent magnets 22 for applying a downward magnetic force to the mover 16 are installed on an upper surface of the upper cylinder 20.

An open coil 24 for forming an attenuating magnetic force (i.e., a magnetic force opposite to a magnetic force from the permanent magnets 22) by external power is positioned on a bottom surface of the upper cylinder 20. And, an open spring 26 for applying an upward elastic force to the mover 16 is installed on a bottom surface of the lower cylinder 14.

Referring to FIG. 1, the permanent magnets 22 are in a state to apply an attractive force to the mover 16, and the open spring 26 is in a compressed state to apply an upward elastic force. However, the elastic force of the open spring 26 is less than the magnetic force of the permanent magnets 22, the mover 16 maintains a downward moved state as shown in FIG. 1. Under this state, once power is supplied to the open coil 24, a magnetic force is generated in an opposite direction to the magnetic force of the permanent magnets 22. Accordingly, the magnetic force of the permanent magnets 22 is attenuated, and thereby the elastic force of the open coil 24 becomes relatively larger. As a result, the mover 16 is upwardly moved as shown in FIG. 2.

Then, power to the open coil 24 is cut off, and power is supplied to the close coil 18. This allows the magnetic force of the permanent magnets 22 and the close coil 18 to become relatively larger than the elastic force of the open spring 26. Accordingly, the mover 16 maintains the downward moved state as shown in FIG. 1.

However, the conventional monostable permanent magnetic actuator has the following problems.

Firstly, when power is supplied to the close coil or the open coil so as to upwardly or downwardly move the mover 16, an eddy current is generated by drastic change of a magnetic flux. This eddy current generates force in an opposite direction to the moving direction of the mover 16, thereby lowering the operation of the mover 16. Furthermore, this eddy current causes the actuator to have a long operation time and large operation energy, thereby badly influencing on the actuator.

Secondly, the middle cylinder and the lower cylinder undergo mechanical processes to have cylindrical shapes. Here, the mechanical processes are performed with high costs.

Thirdly, since a magnetic force to downwardly move the mover is applied only to an upper plate of the mover, it is difficult to obtain a sufficient attractive force.

SUMMARY OF THE INVENTION

Therefore, an object of the present invention is to provide a monostable permanent magnetic actuator using a laminated steel core capable of reducing an eddy current that badly influences on an operation characteristic thereof.

Another object of the present invention is to provide a monostable permanent magnetic actuator using a laminated steel core capable of facilitating mechanical processes, and reducing fabrication costs.

To achieve these and other advantages and in accordance with the purpose of the present invention, as embodied and broadly described herein, there is provided a monostable permanent magnetic actuator using a laminated steel core, comprising: lamination cores formed as a plurality of metallic thin plates are laminated to each other; a coil disposed to be adjacent to the lamination cores, and configured to apply a magnetic force to the lamination cores by an external power; a mover mounted in the lamination cores so as to be movable in upper and lower directions; permanent magnets installed at the lamination cores, and configured to apply an upward and downward magnetic force to the mover; and an elastic means configured to apply an elastic force to the mover in an opposite direction to the permanent magnets A core of a magnetic circuit may be implemented as a plurality of thin plates are laminated to each other. This may prevent drastic change of a magnetic flux, and thus prevent the occurrence of an eddy current.

The monostable permanent magnetic actuator may further comprise a movable core formed on an upper end of the mover by laminating a plurality of metallic thin plates.

The monostable permanent magnetic actuator may further comprise a guide means disposed in the lamination cores so as to guide an upward and downward motion of the mover.

According to another aspect of the present invention, there is provided a monostable permanent magnetic actuator using a laminated steel core, comprising: one pair of lamination cores formed as a plurality of metallic thin plates are laminated to each other, and disposed to face each other; one pair of fixed plates which form a space having a rectangular sectional surface by connecting ends of said one pair of lamination cores to each other; a coil disposed to be adjacent to the lamination cores in the space, and configured to generate a magnetic force to the lamination cores by external power; a mover mounted in the space so as to be moved in up and down directions; permanent magnets installed in the space, and configured to apply an upward and downward magnetic force to the mover; and an elastic means configured to apply an elastic force to the mover in an opposite direction to the permanent magnets.

In the monostable permanent magnetic actuator, an eddy current may be prevented by using the lamination cores. And, the actuator may be formed to have a rectangular appearance, not a cylindrical shape requiring mechanical processes, the rectangular appearance implemented by assembling the lamination cores and the fixed plates with each other. Accordingly, the fabrication processes may be simplified.

The mover may include a stem slidably inserted into a fixed core inside a bottom surface of the space; a head disposed above the stem; and a movable core disposed above the head, and formed as a plurality of thin plates are laminated to each other.

The monostable permanent magnetic actuator may further comprise a guide means configured to guide an upward and downward motion of the mover. The guide means may include guide slots formed in the head in upper and lower directions, and guide bars supported by the fixed plates. Since the mover may move in a state that the guide bars have been inserted into the guide slots, the mover may stably move.

A stopper contacting an inner surface of the fixed core may be additionally mounted to the end of the stem. And, in order to prevent noise and vibration that may occur when the stopper collides with the fixed core, a damping member for attenuating an impact due to contact between the stopper and the fixed core may be mounted to an inner surface of the fixed core.

The monostable permanent magnetic actuator may have an enhanced operation characteristic by preventing the occurrence of an eddy current. And, the fabrication costs may be reduced by implementing the entire structure in a shape requiring minimized mechanical processes.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Hereinafter, an actuator according to the present invention will be explained in more detail with reference to the attached drawings.

Figure 1:
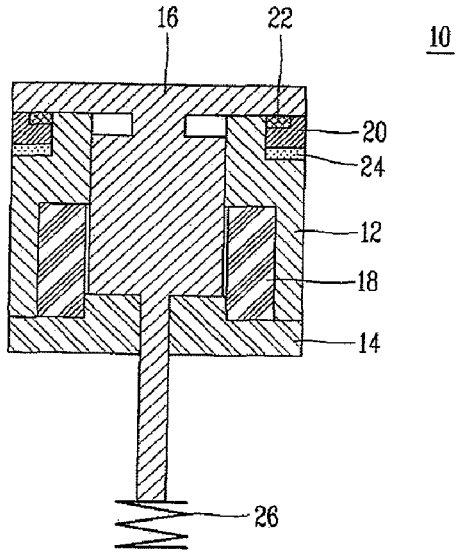
FIGS. 1 and 2 are sectional views of an actuator in accordance with the conventional art.
Figure 2:
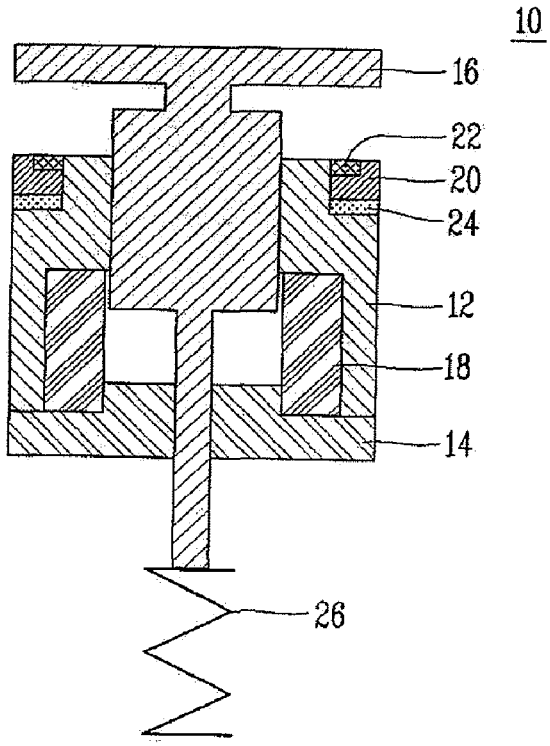
Prior Art Fig. 2
Figure 3:
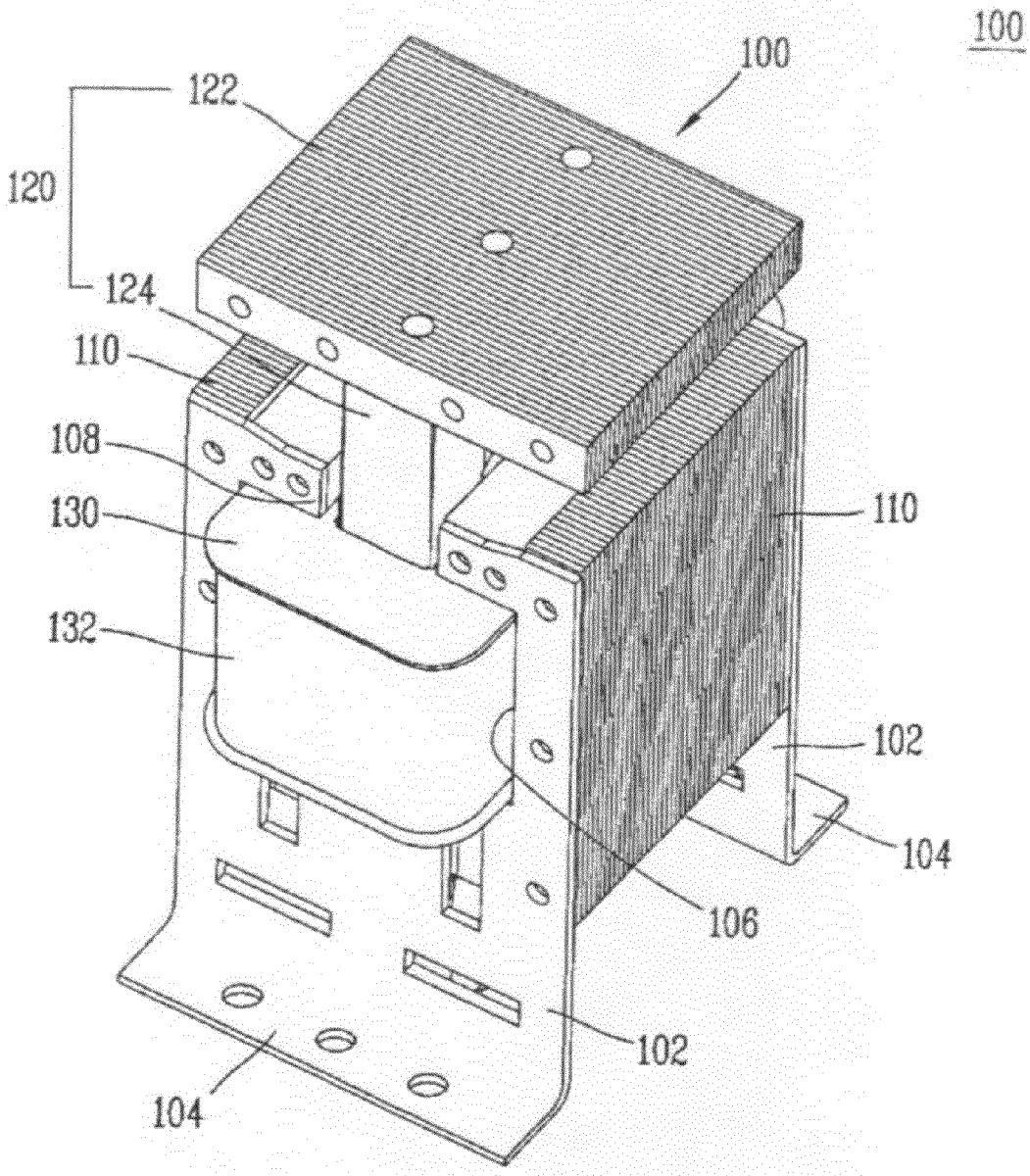
FIG. 3 is a perspective view of an actuator according to one embodiment of the present invention.

Referring to FIG. 3, an actuator 100 according to one embodiment of the present invention comprises one pair of fixed plates 102 disposed to face each other. The fixed plates 102 are configured to provide coupling surfaces with external devices as lower ends 102 thereof are bent. An opening 106 through which a bobbin and a coil that will be later explained are partially exposed out is formed at an upper side of the fixed plates 102. And, a cut-out portion 108 is formed at a central portion of an upper end of the fixed plates 102, through which a head of a mover 120 can be moved in upper and lower directions. Lamination cores 110 are fixed between said one pair of fixed plates 102. As the fixed plates 102 and the lamination cores 110 are coupled to each another, an assembly having a rectangular sectional surface is implemented. The assembly serves as an outer body of the actuator. In the assembly, the mover 120 is mounted so as to be movable in up and down directions. The mover 120 includes a movable core 122 formed as thin plates are laminated to each other, and a head 124 fixed to a lower side of the movable core 122. The mover 120 further includes a stem, which will be later explained.

Figure 4:
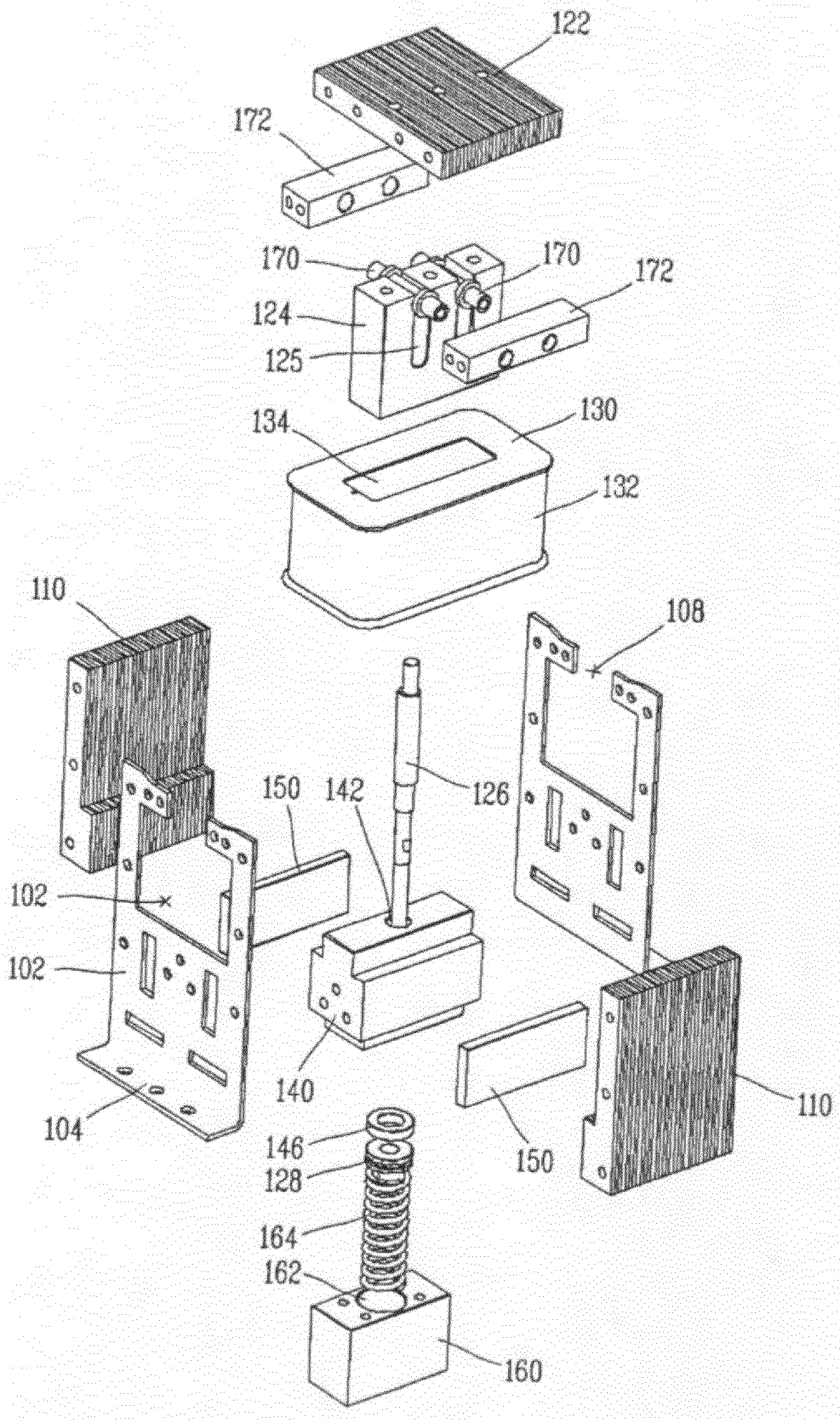
FIG. 4 is an exploded perspective view of the actuator of FIG. 3.

The head 124 is inserted into a bobbin 130, and a coil 132 is wound on an outer surface of the bobbin 130. Referring to FIG. 4, an insertion opening 134 is formed at a central portion of the bobbin 130, and the head 124 is inserted into the insertion opening 134. A shaft type of stem 126 extending to one direction is fixed to a bottom surface of the head 124. And, the stem 126 is inserted into a stem fixing hole 142 formed at a fixed core 140 positioned between the lamination cores 110.

One pair of permanent magnets 150 are fixed between the fixed core 140 and the lamination cores 110. The permanent magnets 150 transmit a magnetic force to the fixed core 140 and the lamination cores 110 by contacting thereto.

A spring guide 160 is positioned below the fixed core 140, and an open spring 164 is inserted into a guide hole 162 formed at a central portion of the spring guide 160. A stopper 128 having a hook shape contacts an upper end of the open spring 164, and is fixed to the end of the stem 126. Accordingly, an elastic force of the open spring 164 is transmitted to the stem 126 through the stopper 128.

A spring guide hole 144 (refer to FIG. 5) is formed on a bottom surface of the fixed core 140, and an upper end of the open spring 164 is inserted into the spring guide hole 144. A damping member 146 is interposed between the stopper 128 and the fixed core 140, thereby preventing noise and vibration that may occur when the stopper 128 collides with an inner surface of the spring guide hole 144.

One pair of guide slots 125 are extendingly formed at the head 124 in parallel to the up and down direction of the head 124. One guide bar 170 is inserted into each of the guide slots 125. Here, the guide bar 170 has an outer diameter equal to or a little smaller than a width of the guide slot 125. Fixed blocks 172 are coupled to both ends of the guide bar 170. The fixed blocks 172 are fixed between said one pair of fixed plates 102. Accordingly, the guide bars 170 are fixed by the fixed plates 102, thereby guiding motion of the head 124 in upper and lower directions.

Hereinafter, the operation of the monostable permanent magnetic actuator according to the present invention will be explained.

Figure 5:
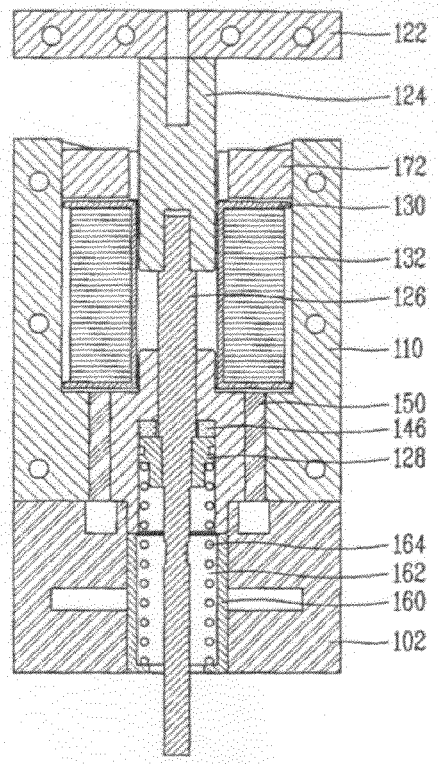
FIG. 5 is a sectional view of the actuator of FIG. 3.

FIG. 5 is a sectional view of the actuator of FIG. 3, which shows that the mover 120 is located at an upper position. And, FIG. 6 is a sectional view of the actuator of FIG. 3, which shows that the mover 120 is located at a lower position.

Figure 6:
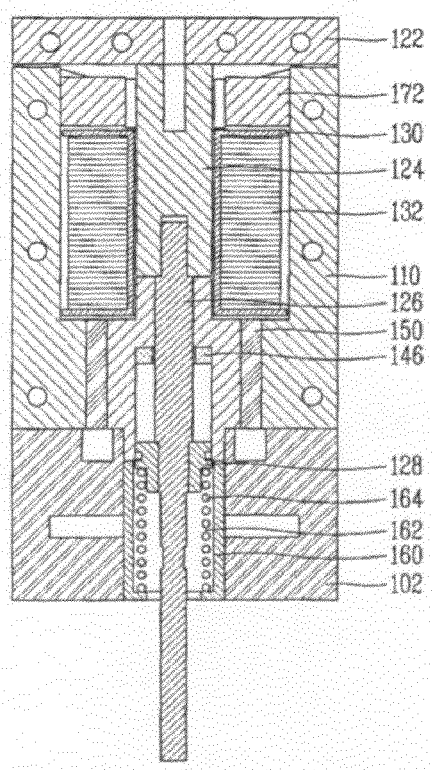
FIG. 6 is a sectional view of the actuator of FIG. 3, which shows that a mover has been downwardly moved.

Referring to FIG. 6, a magnetic flux of the permanent magnets 150 is implemented by a magnetic circuit composed of the movable core 122, the head 124, and the fixed core 140. Accordingly, the mover 120 is located at a lower position by a magnetic force from the permanent magnets 150. Under this state, once a current (close current) is applied to the coil 132 in an opposite direction to the direction of the magnetic flux of the permanent magnets 150, an attractive force toward the head 124 and the movable core 122 is decreased. Accordingly, the magnetic force of the permanent magnets 150 becomes less than the elastic force of the open spring 164. As a result, the mover 120 is moved to an upper position as shown in FIG. 5.

Under this state, even if a current applied to the coil is cut-off, the elastic force of the open spring 164 is larger than the magnetic force of the permanent magnets 150. Accordingly, the mover 120 can be still disposed at the upper position.

Then, once a current (open current) is applied to the coil 132 in the same direction as the direction of the magnetic flux of the permanent magnets 150, a magnetic force between the movable core 122 and the lamination cores 110 is small due to a large air gap therebetween, whereas a magnetic force between the head 124 and the fixed core 140 is relatively large at first. Accordingly, a main magnetic path is formed between the head 124 and the fixed core 140. Then, if the air gap is decreased as the mover 120 gradually moves in a downward direction, a main magnetic path is formed between the movable core 122 and the lamination cores 110, whereas a supplementary magnetic path is formed between the head 124 and the fixed core 140. As the magnetic force is continuously applied to the moved 120, the mover 120 is moved to be in the state of FIG. 6. And, the mover 120 can maintain its state shown in FIG. 6 by the magnetic force of the permanent magnets 150 even if current supply is cut off.

Figure 7:
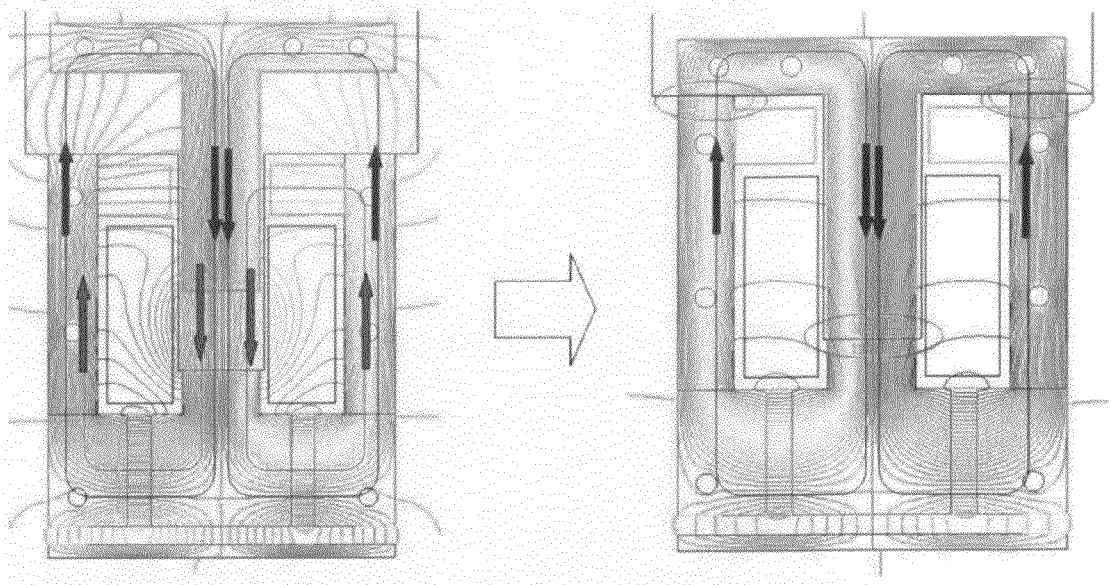
FIGS. 7 and 8 are views showing magnetic flux distribution while the actuator of FIG. 3 is operated.
Figure 8:
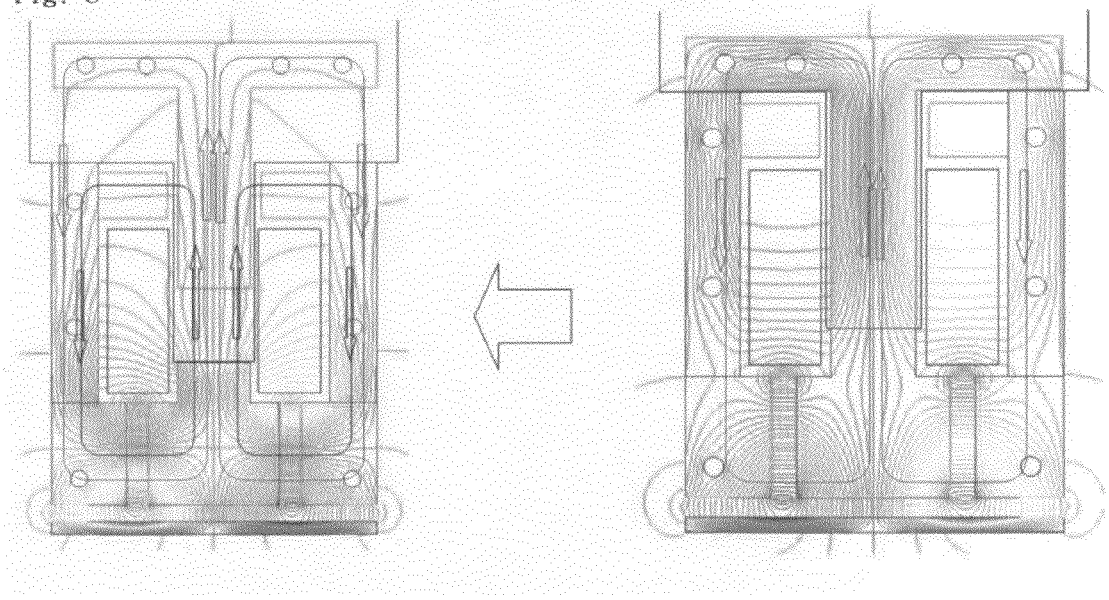

FIGS. 7 and 8 are views showing magnetic flux distribution while the actuator of FIG. 3 is operated.

The left drawing of FIG. 7 shows magnetic flux distribution when a close current has been applied to a coil so as to move the mover 120 to a lower position from an upper position. On the contrary, the right drawing of FIG. 7 shows magnetic flux distribution when the close current has been cut-off under a state that the mover 120 has been moved to the lower position.

Referring to the left drawing of FIG. 7, the mover is disposed at the upper position when a close current is applied. Before the mover moves by a current applied to a coil, a magnetic resistance on the supplementary magnetic path (red loop) is smaller than that on the main magnetic path (blue loop). Accordingly, the supplementary magnetic path has larger magnetic flux than the main magnetic path. This is implemented so as to enhance the efficiency by flowing a small current to the coil by decreasing a magnetic resistance at the first time. Once the mover moves to the lower position by the magnetic flux distributed on the main magnetic flux and the supplementary magnetic flux, the magnetic flux on the main magnetic flux is continuously increased. However, once the mover reaches the lower position, the current applied to the coil is not applied to the mover by a controller. Here, the mover is held only by magnetic energy from the permanent magnets. In this case, the magnetic flux is distributed only on the main magnetic path, not on the supplementary magnetic path, thereby holding the mover 120. The holding force occurs at three parts, i.e., at contact portions near both ends of the movable core of the mover (pink colors of right and left sides of an upper end), and a contact portion of a middle part of a lower end. Accordingly, the holding force can be increased.

The right drawing of FIG. 8 shows magnetic flux distribution under a state that an open current has been applied to the mover being disposed at the lower position. On the contrary, the left drawing of FIG. 8 shows magnetic flux distribution under a state that the open current applied to the mover has been cut-off after the mover moved to the upper position.

Referring to the right drawing of FIG. 8, the mover is disposed at the lower position before applying an open current. Once the open current is applied to the coil, a magnetic flux occurs in an opposite direction to the direction of the magnetic flux of the permanent magnets. Accordingly, the magnetic flux of the permanent magnets for holding the mover at both ends and central contact portion of the movable core is decreased, thereby decreasing the holding force of the mover. As the holding force is continuously decreased to be less than force applied to the mover from the open spring and the outside (contact pressure spring of a circuit breaker), the mover is moved to the upper position by the force transmitted from the open spring and the outside. Once the mover reaches the upper position, the current applied to the coil is not applied to the mover by the controller, but only the magnetic flux of the permanent magnets remains. The magnetic flux of the permanent magnet is more distributed on the supplementary magnetic path (blue loop) than on the main magnetic path (brown loop). Accordingly, the holding force of the mover becomes far less, and the mover is held at the upper position by the elastic force of the open spring.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A monostable permanent magnetic actuator using a laminated steel core, comprising:

lamination cores formed as a plurality of metallic thin plates which are laminated to each other;

a coil disposed to be adjacent to the lamination cores, and configured to apply a magnetic force to the lamination cores by an external power;

a mover mounted in the lamination cores so as to be movable in upper and lower directions;

permanent magnets installed at the lamination cores and configured to apply an upward and downward magnetic force to the mover;

a guider configured to guide an upward and downward motion of the mover;

and an elastic member configured to apply an elastic force to the mover in an opposite direction to the permanent magnets, wherein the mover comprises:

a stem slidably inserted into a fixed core inside a bottom surface of a space defined between laminated cores;

a head disposed above the stem; and a movable core disposed above the head and formed as a plurality of thin plates which are laminated to each other; and wherein the guider comprises:

guide slots formed in the head in upper and lower directions; and guide bars supported by the fixed plates, wherein the mover moves in a state that the guide bars has been inserted into the guide slots.

2. The actuator of claim 1, wherein the movable core is formed on an upper end of the mover.

3. The actuator of claim 1, wherein the guider is disposed in the lamination cores so as to guide the upward and downward motion of the mover.

4. A monostable permanent magnetic actuator using a laminated steel core, comprising:

one pair of lamination cores formed as a plurality of metallic thin plates which are laminated to each other, and disposed to face each other;

one pair of fixed plates which form a space having a rectangular sectional surface by connecting ends of said one pair of lamination cores to each other;

a coil disposed to be adjacent to the lamination cores in the space and configured to generate a magnetic force to the lamination cores by external power;

a mover mounted in the space so as to be moved in up and down directions;

permanent magnets installed in the space, and configured to apply an upward and downward magnetic force to the mover;

a guider configured to guide an upward and downward motion of the mover;

and an elastic member configured to apply an elastic force to the mover in an opposite direction to the permanent magnets, wherein the mover comprises:

a stem slidably inserted into a fixed core inside a bottom surface of the space;

a head disposed above the stem; and a movable core disposed above the head and formed as a plurality of thin plates which are laminated to each other; and wherein the guider comprises:

guide slots formed in the head in upper and lower directions; and guide bars supported by the fixed plates, wherein the mover moves in a state that the guide bars has been inserted into the guide slots.

5. The actuator of claim 4, wherein a stopper contacting an inner surface of the fixed core is additionally mounted to the end of the stem.

6. The actuator of claim 5, wherein a damping member for attenuating an impact due to contact between the stopper and the fixed core is mounted to an inner surface of the fixed core.

* * * * *